US007178355B2

(12) United States Patent
Moffitt

(10) Patent No.: US 7,178,355 B2
(45) Date of Patent: Feb. 20, 2007

(54) HVAC DESICCANT WHEEL SYSTEM AND METHOD

(75) Inventor: Ronnie R. Moffitt, Harrodsburg, KY (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 11/332,652

(22) Filed: Jan. 17, 2006

(65) Prior Publication Data

US 2006/0117781 A1 Jun. 8, 2006

(51) Int. Cl.
*F25D 23/00* (2006.01)

(52) U.S. Cl. ..... 62/271

(58) Field of Classification Search ..... 62/271, 62/304, 309, 310, 324.6, 434; 96/125, 127, 96/153

See application file for complete search history.

(56) References Cited

U.S. PATENT DOCUMENTS 4,719,761 A 1/1988 Cromer
4,825,936 A 5/1989 Hoagland et al.
5,353,606 A * 10/1994 Yoho et al. ..... 62/271
5,517,828 A 5/1996 Calton et al.
5,551,245 A 9/1996 Calton et al.
5,579,647 A 12/1996 Calton et al.
5,649,428 A * 7/1997 Calton et al. ..... 62/94
5,732,562 A 3/1998 Moratalla
5,761,915 A * 6/1998 Rao ..... 62/94
5,816,065 A 10/1998 Maeda
5,826,443 A * 10/1998 Ares et al. ..... 62/324.1
5,860,284 A * 1/1999 Goland et al. ..... 62/94
5,887,784 A 3/1999 Haas
5,966,955 A * 10/1999 Maeda ..... 62/238.3
6,018,953 A * 2/2000 Belding et al. ..... 62/94
6,029,467 A * 2/2000 Moratalla ..... 62/271
6,050,100 A * 4/2000 Belding et al. ..... 62/271
6,094,835 A * 8/2000 Cromer ..... 34/80
6,141,979 A 11/2000 Dunlap
6,199,388 B1 * 3/2001 Fischer, Jr. ..... 62/90
6,237,354 B1 5/2001 Cromer
6,311,511 B1 11/2001 Maeda
6,328,095 B1 * 12/2001 Felber et al. ..... 165/54

FOREIGN PATENT DOCUMENTS

DE 3626887 A1 * 2/1988
JP 2002-340370 A * 11/2002

* cited by examiner

*Primary Examiner*—Mohammad M. Ali
(74) *Attorney, Agent, or Firm*—William J. Beres; William O'Driscoll

(57) ABSTRACT

An HVAC system includes a desiccant wheel, wherein the wheel's speed varies with airflow, the wheel is energized for at least a set period at startup, and/or a heat recovery system (e.g., an air-to-air heat exchanger) upstream of the wheel enhances the system's ability to dehumidify air.

2 Claims, 4 Drawing Sheets

HVAC DESICCANT WHEEL SYSTEM AND METHOD

BACKGROUND OF THE INVENTION

1. Field of the Invention

The subject invention generally pertains to HVAC systems and more specifically to an air conditioning system that includes a dehumidifying desiccant wheel.

2. Description of Related Art

Energy wheels and desiccant wheels are two distinct types of wheels used in the HVAC industry. An energy wheel is a rotating, porous mass that functions as heat exchanger by transferring sensible heat from one air stream to another. With an energy wheel, half the wheel absorbs heat while the other half releases it. Examples of energy wheels are disclosed in U.S. Pat. Nos. 6,141,979 and 4,825,936.

Desiccant wheels, on the other hand, transfer moisture from one air stream to another, usually for the purpose of reducing humidity of a comfort zone. Examples of systems with desiccant wheels are disclosed in U.S. Pat. Nos. 6,311,511; 6,237,354; 5,887,784; 5,816,065; 5,732,562; 5,579,647; 5,551,245; 5,517,828 and 4,719,761.

Although many air conditioning systems that are enhanced with desiccant wheels have been developed, such systems often implement the use of desiccant wheels whenever there is a dehumidification load. However many air conditioning systems may be most efficient if the desiccant wheel is only utilized at part load conditions or when the load on the system shifts from a sensible cooling load to more of a latent cooling or dehumidification load. Current systems often fail to address these efficiency concerns. Moreover, current systems with desiccant wheels often disregard a critical period when the refrigerant system is first activated. At startup, it takes a moment for the refrigerant system's evaporator to become sufficiently cold to remove moisture from the air. So, when the refrigerant system is first energized and before the evaporator becomes cold, condensed water on the surface of the evaporator may actually evaporate into the air, which can increase the humidity of the comfort zone.

Consequently, a need exists for air conditioning systems that are enhanced with desiccant wheels that address efficiency concerns at part load operation for variable air volume systems.

SUMMARY OF THE INVENTION

It is a primary object of the invention to improve an HVAC system's overall effectiveness by configuring the system with a desiccant wheel in a manner that takes full advantage of the wheel's ability to reduce humidity over a variety of operating conditions.

Another object of some embodiments is to start a refrigerant compressor and the rotation of a desiccant wheel regardless of the surrounding humidity, and then discontinue the wheel's rotation after a predetermined period, whereby the wheel, during the predetermined period, can reabsorb moisture that may have vaporized off an evaporator at startup.

Another object of some embodiments is to discontinue the rotation of a desiccant wheel in response to a humidistat indicating that the humidity is below a certain level.

Another object of some embodiments is to discontinue the rotation of a desiccant wheel in response to a thermostat indicating that the air temperature is above a certain level.

Another object of some embodiments is to vary the rotational speed of a desiccant wheel in proportion to the airflow volume through the wheel.

Another object of some embodiments is to vary the rotational speed of a desiccant wheel in proportion to the airflow volume through the wheel, wherein the airflow volume is determined based on a controller's speed command signal to a variable speed blower.

Another object of some embodiments is to vary the rotational speed of a desiccant wheel in proportion to the airflow volume through the wheel, wherein the airflow volume is determined based on an airflow sensor.

Another object of some embodiments is to preheat the air entering a desiccant wheel in response to a humidistat, wherein the preheating assists the wheel in reducing the humidity in situations where the rotational speed of the wheel is reduced due to lower airflow rates.

Another object of some embodiments is to heat the air entering one portion of a desiccant wheel and cooling the air entering another portion of the wheel, wherein the heating is in response to a humidistat, and the cooling is in response to a temperature sensor.

Another object of some embodiments is to decrease the cooling rate of a desiccant wheel system to meet a reduced sensible cooling demand, while maintaining or just slightly decreasing a heating rate to meet a latent heating demand.

Another object of some embodiments is to install a heat recovery system upstream of a desiccant wheel to meet both a latent and sensible cooling demand. An air-to-air heat exchanger and a condenser/evaporator refrigerant circuit are just two examples of such a heat recovery system.

Another object of some embodiments is to meet a latent cooling demand without having to preheat the incoming air or otherwise increase the sensible cooling demand.

Another object of some embodiments is to provide an HVAC enclosure that conveys more airflow in some sections than others to accommodate the influx of both outside air and return air.

Another object of some embodiments is to install a pre-dehumidifying heat recovery system upstream of the desiccant wheel to meet both a latent and sensible cooling demand.

One or more of these and/or other objects of the invention are provided by an HVAC system that includes a desiccant wheel, wherein the configuration and/or control of the system is such that the system takes full advantage of the wheel's ability to cool and dehumidify the air of a comfort zone under various conditions.

DESCRIPTION OF THE PREFERRED EMBODIMENT

Figure 1:
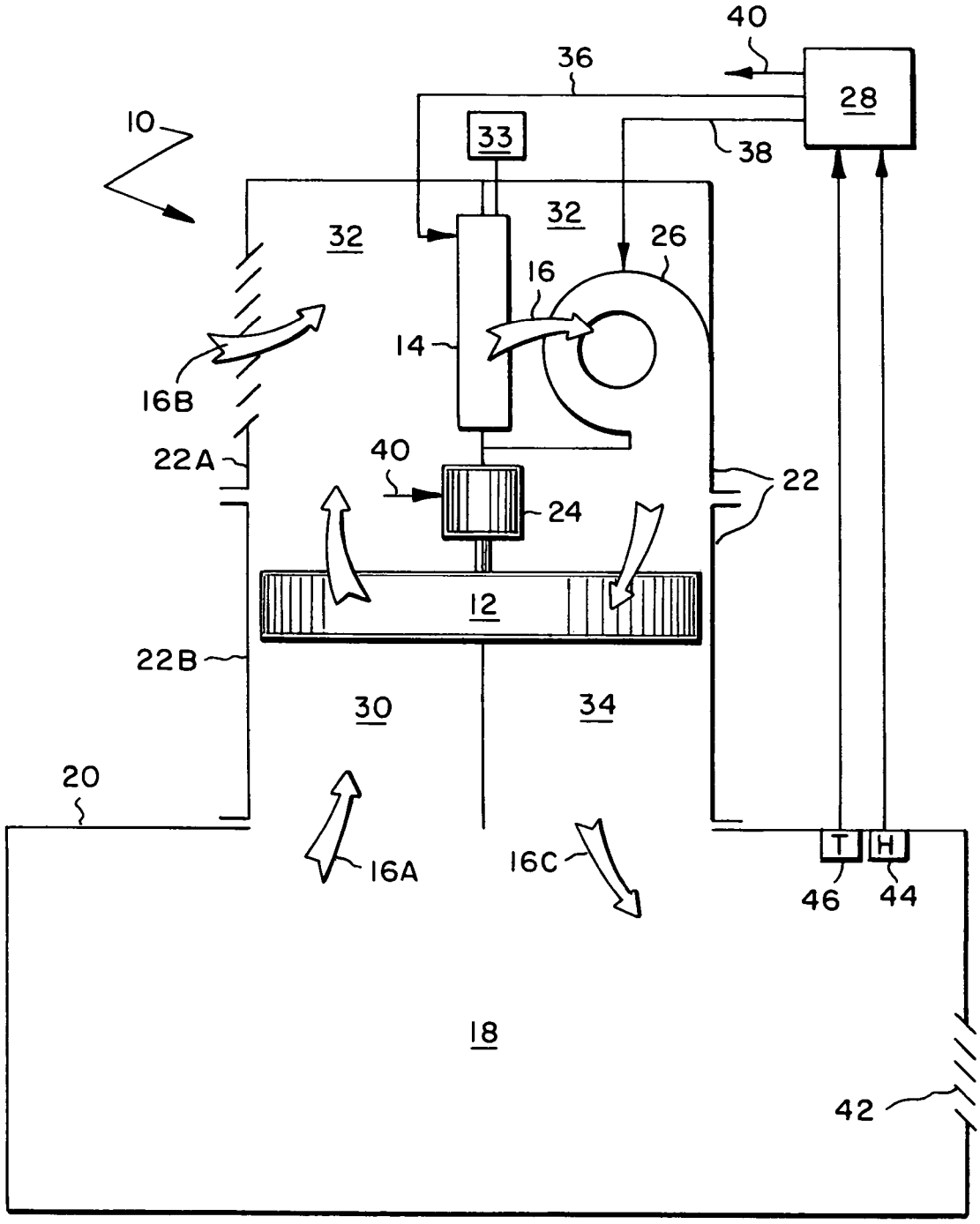
FIG. 1 is a schematic diagram of one embodiment of an HVAC system that includes a desiccant wheel.

A refrigerant system 10, shown in FIG. 1, is cycled on and off to meet a latent and/or sensible cooling demand, wherein a desiccant wheel 12 of the system operates for at least a predetermined period at the beginning of each cycle. At the start of each cycle, it can take a moment for a cooling coil 14, such as an evaporator of a refrigerant circuit, to become sufficiently cool to condense moisture from the air 16. Moisture, which may have condensed on the surface of coil 14 during an earlier operating cycle, may later evaporate back into the air upon starting a new cycle. So, operating wheel 12 for a predetermined period at startup can help absorb that moisture before it raises the humidity of a comfort zone 18, such as a room or other area of a building 20.

For the illustrated embodiment, system 10 comprises an enclosure 22 that contains cooling coil 14, desiccant wheel 12 driven by a motor 24, a blower 26, and a controller 28.

Enclosure 22 is schematically illustrated to represent any structure or combination of structures that can define an upstream air passageway 30, an intermediate air passageway 32, and a downstream air passageway 34. In this example, enclosure 22 comprises a cabinet 22A and a roof curb 22B, wherein roof curb 22B attaches cabinet 22A to a roof of building 20. Although enclosure 22 is shown having its two components, cabinet 22A and roof curb 22B, adjacent to each other, other embodiments may have an enclosure whose components are separated or interconnected by ductwork.

Cooling coil 14 is schematically illustrated to represent any structure that can cool a stream of air by means of a chilled fluid from a chilled fluid source 33. Examples of a chilled fluid source 33 for coil 14 include, but are not limited to, a conventional evaporator of a conventional refrigerant circuit, and a heat exchanger that conveys chilled water.

Blower 26 is schematically illustrated to represent any apparatus that can move air 16 through enclosure 22. Examples of blower 26 include, but are not limited to, a centrifugal fan, an axial fan, etc. Although blower 26 is shown disposed within intermediate air passageway 32, blower 26 could be installed anywhere as long as it can move air 16 in an appropriate flow path through enclosure 22.

Desiccant wheel 12 is schematically illustrated to represent any rotatable, air-permeable structure that can absorb and release moisture from a stream of air 16. Wheel 12, for example, may comprise a honeycomb structure or porous pad or cage that contains or is coated with a desiccant, such as silica gel, montmorillonite clay, zeolite, etc. The actual structure of various desiccant wheels are well know to those skilled in the art. Examples of desiccant wheels are disclosed in U.S. Pat. Nos. 6,311,511; 6,237,354; 5,887,784; 5,816,065; 5,732,562; 5,579,647; 5,551,245; 5,517,828 and 4,719,761, all of which are specifically incorporated by reference herein.

Controller 28 provides at least one output signal that cycles cooling coil 14 and blower 26 on and off to meet the cooling and/or dehumidification demand of comfort zone 18. In this example, controller 28 provides an output signal 36 for selectively energizing or energizing the source 33 of chilled fluid and/or the cooling coil 14 (or its associated refrigerant compressor) and an output signal 38 for energizing blower 26. Controller 28 also provides another output signal 40 for selectively energizing and de-energizing motor 24 of desiccant wheel 12. Controller 28 is schematically illustrated to represent any device that can provide such output signals. Examples of controller 28 include, but are not limited to, an electromechanical relay circuit, thermostat, PLC (programmable logic controller), computer, microprocessor, analog/digital circuit, and various combinations thereof.

Under normal operation, blower 26 draws return air 16A and/or outside air 16B into intermediate air passageway 32 and across coil 14, which provides latent and sensible cooling of the air. Next, blower 26 forces the conditioned air from intermediate air passageway 32 through a portion of wheel 12 that absorbs moisture from supply air 16C. Downstream air passageway 34 then conveys the relatively cool, dry supply 16C to comfort zone 18. Some of the air in zone 18 may escape building 20 through a vent 42 or other outlet, and the rest of the air becomes return air 16A that blower 26 draws back into upstream air passageway 30. As wheel 12 rotates, wheel 12 carries the moisture it absorbed in downstream passageway 34 and releases the moisture to the return air 16A passing through upstream air passageway 30.

Upon initially activating the source 33 and/or cooling coil 14 and blower 26 at the beginning of each on-cycle, controller 28 actuates or rotates wheel 12 for a predetermined limited period, e.g., five or ten minutes, regardless of any current dehumidification need. During this period, wheel 12 can absorb moisture that the surface of coil 14 may have accumulated from a previous on-cycle and is currently evaporating from that surface. Such evaporation can be caused by air 16 passing across the surface of coil 14 before the coil is sufficiently cool to hold the moisture in a condensed state. With wheel 12 rotating at the beginning of every on-cycle, downstream air passageway 34 can immediately convey relatively dry supply air 16C to comfort zone 18.

Once the predetermined period expires, signal 40 can de-activate wheel 12, while cooling coil 14 and blower 26 continue operating to meet the sensible cooling demand of zone 18. If, however, a humidistat 44 determines that a dehumidification demand exists after the predetermined period expires, signal 40 may command wheel 12 to continue operating.

In some cases system 10 may have difficulty meeting the sensible cooling demand of zone 18. Such an overload can be determined based on a thermostat 46 indicating that the zone temperature has risen to a certain level (e.g., two degrees above a target zone temperature) even though system 10 is still operating. In such situations, signal 40 may de-activate wheel 12 until system 10 can satisfy the zone's sensible cooling demand.

Figure 2:
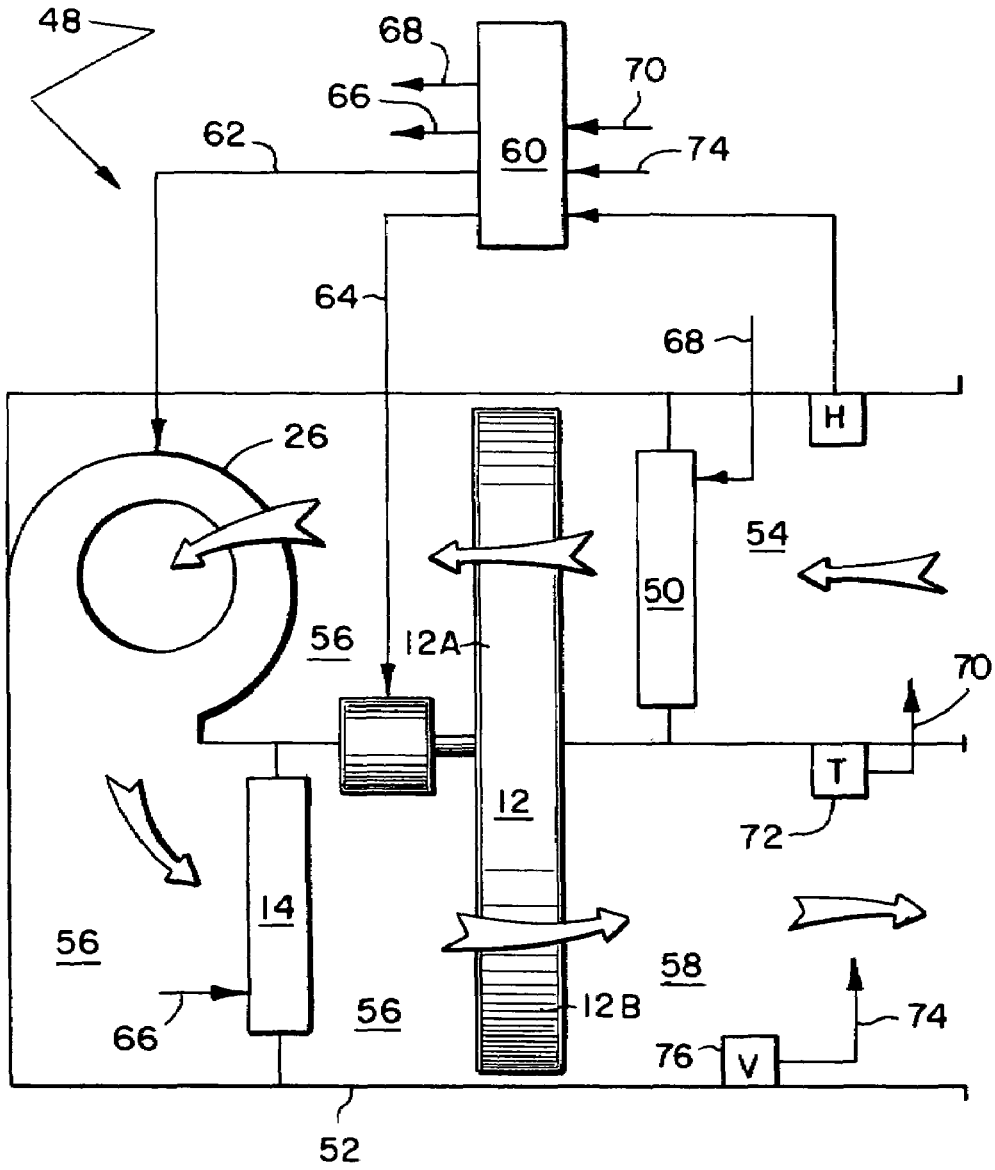
FIG. 2 is a schematic diagram of a second embodiment of an HVAC system that includes a desiccant wheel.

In another embodiment, shown in FIG. 2, a refrigerant system 48 comprises desiccant wheel 12, blower 26, cooling coil 14, an optional heater 50, and an enclosure 52. Enclosure 52 defines an upstream air passageway 54, an intermediate air passageway 56, and a downstream air passageway 58. Blower 26 forces air sequentially through upstream passageway 54, through heater 50, through a first portion 12A of wheel 12 that releases moisture to the air, into intermediate air passageway 56, through blower 26, through cooling coil 14 to provide latent and sensible cooling, through another portion 12B of wheel 12 to absorb moisture from the air, into downstream passageway 58, and onto a comfort zone. The air in downstream air passageway 58 is supply air, and the air in upstream air passageway 54 can be return air and/or outside air. In this case, wheel 12 transfers moisture from the supply air to the return air or outside air.

System 48 is particularly suited for VAV systems where the cooling demand of a building is met by a system that delivers supply air at a variable air volume. A controller 60, similar to controller 28, provides one or more output signals to system 48. Output signal 62, for example, controls the speed or airflow volume of blower 26, an output signal 64 controls the rotational speed of wheel 12, an output signal 66 controls cooling coil 14 (e.g., by selectively actuating its associated compressor), and an output signal 68 controls the operation of heater 50. To meet the building's cooling needs, controller 60 varies the air delivery of blower 26 by providing output signal 62 in response to an input signal 70 from a temperature sensor 72.

To help maintain the wheel's efficiency over a range of airflow volumes, controller 60 provides output signal 64 such that the rotational speed of wheel 12 increases with the air volume. The wheel's speed is preferably adjusted to be proportional to the blower's speed or airflow volume. Controller 60 can determine the airflow volume by way of an input signal 74 from a conventional airflow sensor 76. Alternatively, controller 60 can simply assume the airflow volume or blower speed agrees with output signal 62, whereby flow sensor 76 can be omitted.

Heater 50, which is optional, can be used for preheating the return air in situations where the rest of system 48 is unable to effectively dehumidify the air without excessively cooling the supply air to a level where the comfort zone begins feeling unpleasantly cold. Heater 50 can be a primary or auxiliary condenser of the same refrigerant circuit that contains cooling coil 14, or heater 50 can be a separate heater, such as an electric heater, hot water coil, radiator, etc.

In some cases where the sensible cooling demand drops significantly while the latent cooling demand remains high, the heat transfer rate between heater 50 and the current of air passing therethrough can remain constant or be reduced by a first delta-heat transfer rate, and the heat transfer rate between cooling coil 14 and the current of air passing therethrough can be reduced by a second delta-heat transfer rate, wherein the second delta-heat transfer rate is greater than the first delta-heat transfer rate. Deactivating or increasing the surface temperature of cooling coil 14 can be the primary cause of the second delta-heat transfer rate, while a decrease in airflow volume can cause the first delta-heat transfer rate. If, however, the airflow volume is not reduced, then the first delta-heat transfer rate may be substantially zero (i.e., the heat transfer rate of heater 68 remains substantially constant).

Figure 3:
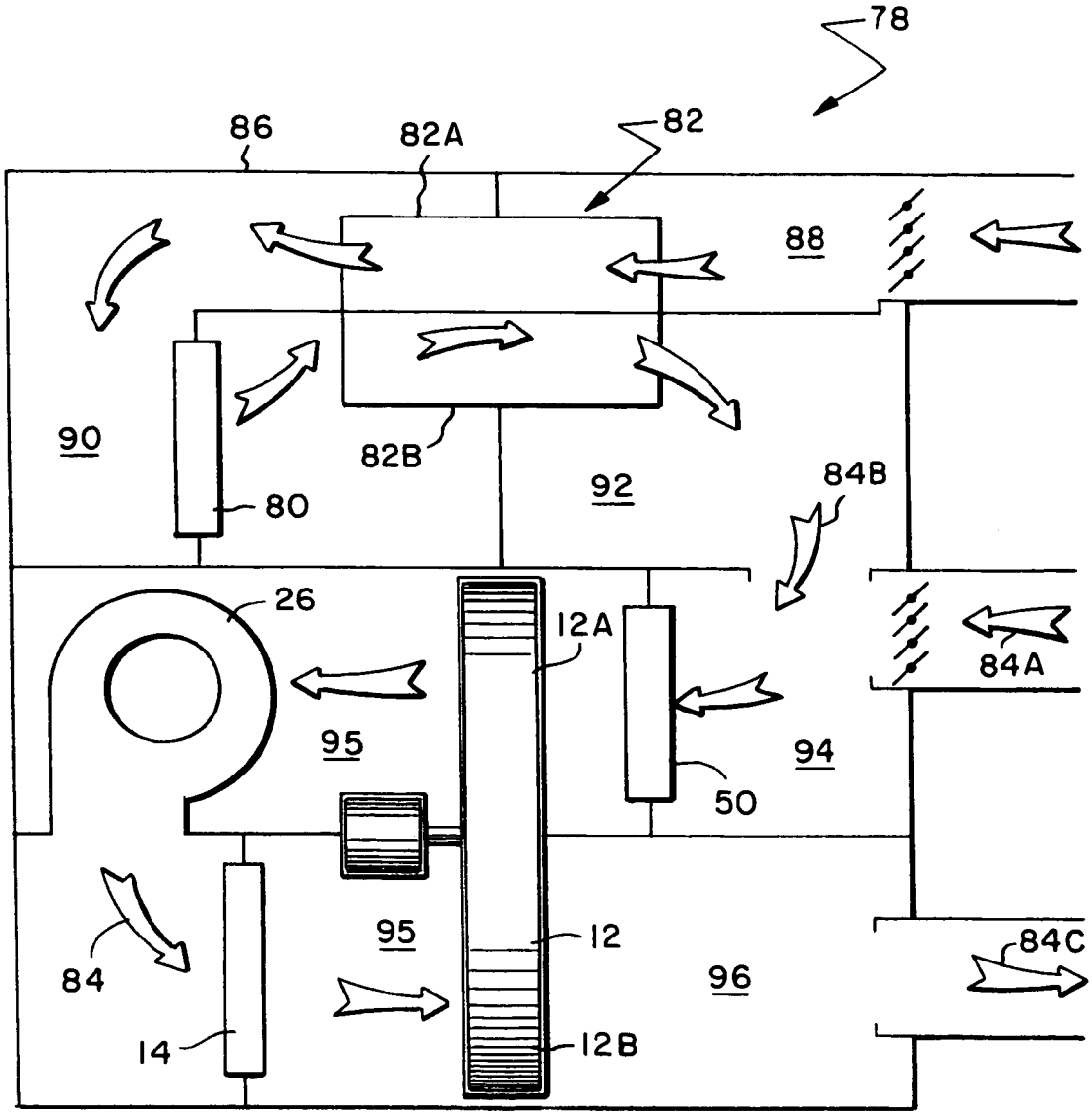
FIG. 3 is a schematic diagram of a third embodiment of an HVAC system that includes a desiccant wheel.

FIG. 3 shows a system 78 that is similar to system 48 of FIG. 2; however, system 78 has a second cooling coil 80 and a heat recovery system 82. With the heat recovery system and second cooling coil, system 78 can provide greater dehumidification with little or no auxiliary heat, i.e., heater 50 may be optional.

System 78 includes blower 26 that forces air 84 through an enclosure 86 that defines various air passageways. In some embodiments, blower 26 forces air 84 sequentially through an outside air inlet 88, a cooling section 82A of heat recovery system 82, an intermediate air chamber 90, cooling coil 80, a heating section 82B of heat recovery system 82, an outside air outlet 92, an upstream air passageway 94 where return air 84A from a comfort zone and outside air 84B can mix, optional heater 50, a moisture-releasing section 12A of desiccant wheel 12, an intermediate air passageway 95 that contains blower 26 and cooling coil 14, a moisture-absorbing section 12B of wheel 12, and a downstream air passageway 96 that discharges supply air 85C to a comfort zone.

From upstream air passageway 94 to downstream air passageway 96, the function of system 78 is very similar to that of system 48. To enhance dehumidification, however, system 78 employs cooling coil 80 and heat recovery system 82. Cooling coil 80 removes moisture from the air, while heat recovery system 82 transfer heat from the air passing from outside air inlet 88 to intermediate air chamber 90 to the air passing from intermediate air chamber 90 to outside air outlet 92, whereby the air moving from outside air outlet 92 to upstream air passageway 94 is cooler and drier than the air entering system 48 of FIG. 2.

The fact that the air in passageway 94 is not only drier but is also cooler than the air in passageway 94 is an important advantage over conventional systems that preheat or warm the air to achieve dehumidification. With conventional systems, reheating the air increases the sensible cooling load. With the current system, however, dehumidification can be achieved without increasing the sensible cooling load, thus the current system is more efficient.

Heat recovery system 82 is schematically illustrated to represent any apparatus for transferring heat from one airstream to another. Heat recovery system 82, for example, can be a conventional air-to-air heat exchanger or it can be the condenser and evaporator of a conventional refrigerant circuit.

Figure 4:
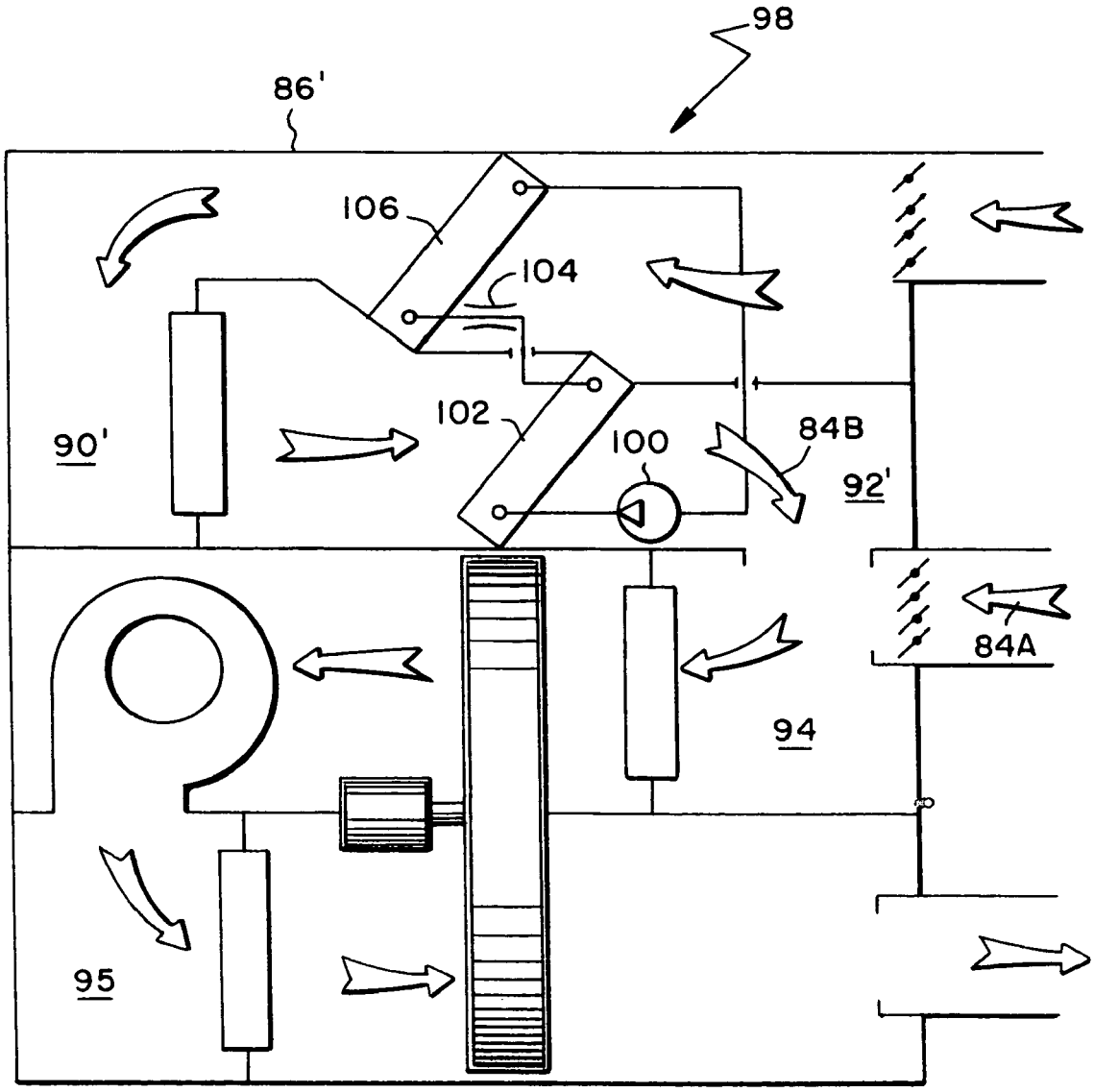
FIG. 4 is a schematic diagram of a fourth embodiment of an HVAC system that includes a desiccant wheel.

Such a refrigerant circuit is incorporated into a system 98 that is illustrated in FIG. 4. System 98 includes a refrigerant circuit that comprises a refrigerant compressor 100, a condenser 102, an expansion device 104 (e.g., a flow restriction, capillary, orifice, expansion valve, etc.), and an evaporator 106. The refrigerant circuit operates in a conventional manner in that compressor 100 discharges hot pressurized refrigerant gas into condenser 102. The refrigerant within condenser 102 condenses as the refrigerant releases heat to the surrounding air (the air passing from an intermediate chamber 90' to an outside air outlet 92'). From condenser 102, the condensed refrigerant cools by expansion by passing through expansion device 104. The refrigerant then enters evaporator 106 where the relatively cool refrigerant absorbs heat from the incoming outside air. From evaporator 106, the refrigerant returns to the inlet of compressor 100 to be compressed again. As a result, the refrigerant circuit transfers heat from the air passing through evaporator 106 to the air passing through condenser 102.

It should be noted, that although upstream air passageway 94 conveys a mixture of outside air 84B and return air 84A, in some embodiments there is no return air, only outside air. In such cases, the airflow volume through intermediate air chamber 90 or 90' is substantially equal to that of intermediate air passageway 95. If, however, enclosure 86 or 86' receives both outside air and return air, then intermediate air passageway 95 conveys more air than does intermediate air chamber 90 or 90'. Any excess air can be released from the building through some sort of exhaust or other opening in the building.

The invention claimed is:

1. A refrigerant system for conditioning air for a comfort zone, the refrigerant system comprising:

an enclosure defining an outside air inlet, an intermediate air chamber, an outside air outlet, an upstream air passageway, an intermediate air passageway, and a downstream air passageway, wherein the air moves downstream sequentially through the outside air inlet, the intermediate air chamber, the outside air outlet, the upstream air passageway, the intermediate air passageway, and the downstream air passageway;

a heat recovery system in fluid communication with the outside air inlet, the intermediate air chamber, and the outside air outlet, wherein the heat recovery system transfers heat from a first current of air to a second current of air, wherein the first current of air travels from the outside air inlet to the intermediate air chamber, and the second current of air travels from the intermediate air chamber to the outside air outlet;

a desiccant wheel able to absorb moisture from the air passing from the intermediate air passageway to the downstream air passageway and simultaneously release moisture to the air passing from the upstream air passageway to the comfort zone; and a cooling coil disposed in the intermediate air chamber.

2. The refrigerant system of claim 1 wherein the heat recovery system is a refrigerant circuit that includes a condenser disposed in heat transfer relationship with the second current of air and an evaporator in heat transfer relationship with the first current of air.

* * * * *

UNITED STATES PATENT AND TRADEMARK OFFICE

CERTIFICATE OF CORRECTION

PATENT NO. : 7,178,355 B2
APPLICATION NO. : 11/332652
DATED : February 20, 2007
INVENTOR(S) : Ronnie R. Moffitt It is certified that error appears in the above-identified patent and that said Letters Patent is hereby corrected as shown below:

Column 6, Line 7, insert paragraph [0048] as follows:

--Although the invention is described with reference to a preferred embodiment, it should be appreciated by those skilled in the art that various modifications are well within the scope of invention. Therefore the scope of the invention is to be determined by reference to the following claims:--

Signed and Sealed this

Seventh Day of August, 2007

JON W. DUDAS
*Director of the United States Patent and Trademark Office*